United States Patent [19]

Fey et al.

[11] Patent Number: 4,526,020

[45] Date of Patent: Jul. 2, 1985

[54] TILTABLE WASHER

[75] Inventors: Robert M. Fey, Rocky Face, Ga.; Ronald L. Altnau, Ripon, Wis.

[73] Assignee: Speed Queen Company, Ripon, Wis.

[21] Appl. No.: 615,968

[22] Filed: May 31, 1984

[51] Int. Cl.[3] ..... D06F 29/02; D06F 39/00

[52] U.S. Cl. ..... 68/3 R; 68/20; 68/210; 248/188.1; 312/276

[58] Field of Search ..... 68/3 R, 19.2, 20, 26, 68/210; 134/115 R; 34/126; 4/312, 638, 644, 663, 664; 312/120, 123, 276; 248/133, 188.1, 188.6, 550

[56] References Cited

U.S. PATENT DOCUMENTS

| | | | |
|---|---|---|---|
| 1,219,367 | 3/1917 | Adams | 312/123 |
| 1,327,489 | 1/1920 | Matthews | 312/270 |
| 2,498,940 | 2/1950 | Bunker | 4/638 X |
| 2,649,699 | 8/1953 | Minor | 312/276 X |

FOREIGN PATENT DOCUMENTS

| | | | |
|---|---|---|---|
| 129357 | 9/1950 | Sweden | 68/26 |

*Primary Examiner*—Philip R. Coe

*Attorney, Agent, or Firm*—William R. Clark; Joseph D. Pannone

[57] ABSTRACT

A top loading clothes washer pivotally supported so that it can be installed underneath a stationary structure and tilted forward for loading and unloading clothes. The pivotal support is provided by a stable base which also includes apparatus such as a hook for preventing forward tilting past a predetermined loading and unloading tilt-out position. The front of the washer is truncated and the tilt axis is backward from the truncation but forward from the washer center of gravity. In the upright washing position, rear feet on the washer provide support for the washer and also engage the base to horizontally secure the washer to the base for stability during spin dynamics. A biased hinge covering the front truncation provides backward torque about the tilt axis so that the washer feet carry a significant amount of the washer weight.

14 Claims, 19 Drawing Figures

TILTABLE WASHER

BACKGROUND OF THE INVENTION

The general field of the invention relates to clothes washers.

The problem of positioning a clothes washer and dryer side-by-side and thereby utilizing a relatively large floor space has been recognized for many years. More specifically, floor space is at a premium in many if not most washer/dryer installations and it is therefore desirable to reduce the required floor space. For example, the limited floor space in many apartment buildings make it impractical to have a clothes washer and dryer for each apartment.

One prior art solution such as described in U.S. Pat. No. 3,324,691 is to use the same tub for washing and drying thereby eliminating one of the two cabinets. Many other problems may be encountered in such a configuration because the design objectives of the two units are not totally compatible and therefore, trade-offs must be made.

Another prior art solution is to reduce the size or capacity of the washer and dryer. Although this obviously reduces the required floor space, it naturally increases the required number of wash loads and therefore has significant disadvantages associated therewith.

A commonly considered approach is to stack the washer and dryer on top of each other. Because of the torque generated in a spin cycle, it is advisable to position the washer on the bottom. In one prior art configuration, both the washer and dryer are front loading so that access to the units is conventional except for the fact that the dryer is somewhat higher than if it were resting on the floor. Access, however, does become a problem if a top loading washer is used for its well recognized advantages over a front loading washer. One top loader approach is to roll or pull the washer out horizontally. Typically, rollers or a ball bearing slide could be used. Such a configuration provides stability to absorb the spin dynamics but requires front floor clearance and somewhat complicates hose connections.

Perhaps the most commonly considered stack approach is to use a top loading washer and truncate the bottom front of the dryer to provide a notch for accessing the washer top. Generally, such a configuration has been used with washers and dryers that are less than full capacity. At a minimum, it may be necessary to use a dryer with less depth and therefore less capacity than the washer. Other significant disadvantages of the notch approach is that it is difficult if not impossible to view the inside of the tub and removal of clothes is substantially encumbered. Part of the reason for these drawbacks is that the lid can't be opened all the way because the dryer is stacked on top.

SUMMARY OF THE INVENTION

In accordance with the invention, a top loading clothes washer is defined such that it is pivotally supported on a stable base so that it is tiltable between an upright washing position and a predetermined forward tilting position used for loading and unloading clothes. The invention has advantage over the prior art in that the washer can be installed underneath a stacked dryer or a countertop and unencumbered access is provided to the top by tilting the washer forward. In this tilt-out position, the tub can be viewed and clothes can easily be removed.

The invention defines the combination of a stable base, a top loading clothes washer pivotally supported on the base wherein the washer is tiltable about an axis of rotation between an upright washing position and a predetermined forward tilting position used for loading and unloading clothes, means for limiting the forward tilting about the rotational axis at a predetermined forward position, and means for limiting backward tilting about the rotational axis at the upright washing position, the backward tilting limiting means comprising means for horizontally securing the washer to the base in the upright washing position. It may be preferable that the foward tilting limiting means comprise a hook connected to the base which hook engages the washer in the predetermined forward position. Also, the backward tilting limiting means may comprise feet connected to the washer which mate with congruent members of the base.

The invention may be practiced by the combination of a top loading clothes washer having a front, a stable base pivotally supporting the washer about an axis of rotation disposed lateral to the washer between the front and the center of gravity of the washer, the washer comprising means engageable to the base for supporting and horizontally securing the rear of the washer to the base when the washer is in an upright washing position, the washer being tiltable about the axis in a forward direction, and means for limiting forward tilting of the washer about the axis at a predetermined tilt-out position used for loading and unloading clothes from the washer.

The invention further defines the combination of a top loading clothes washer having a front, a base pivotally supporting the washer about an axis of rotation lateral to the washer and in front of its center of gravity, the washer having rear feet which mate with congruent members of the base when the washer is in an upright washing position, the feet providing rear support for the washer in the upright washing position and horizontally securing the washer to the base, and the base having a hook for limiting forward tilting of the washer about the axis at a predetermined tilt-out position used for loading and unloading clothes from the washer.

The invention may also be practiced by the combination of a clothes washer having a cabinet comprising a front, sides, and a top with an opening for loading and unloading clothes, the cabinet having a bottom front truncation, a stable base pivotally supporting the washer about a horizontal rotational axis lateral to the washer wherein the washer is tiltable between an upright washing position and a predetermined forward tilted position for loading and unloading clothes through the opening, a hook connected to the base for engaging and limiting forward tilting of the washer at the predetermined forward tilted position, the washer having rear feet for supporting the rear of the washer in the upright washing position, the feet horizontally securing the washer to the base in the upright washing position, and means for providing a torque force for urging the washer to rotate about the axis in a direction from the predetermined forward tilted position towards the upright washing position to engage the feet on the base in the upright washing position. It may be preferable that the combination further comprise pedestals connected to the base and congruent hollows in the feet of the washer wherein the feet are aligned so that the hollows of the feet seat down over the pedestals in the upright washing position. Also, the torque force providing means may comprise a biased hinge connected between the washer and the base.

The invention further defines the combination of a clothes washer having a housing comprising a cabinet front, cabinet sides, a cabinet top having an opening for loading and unloading clothes, and a bottom platform, the housing having a bottom front truncation, a stable base pivotally supporting the washer about a horizontal lateral rotational axis wherein the washer is tiltable between an upright position used for washing and a predetermined forward tilt-out position used for loading and unloading clothes through the opening, means for limiting forward tilting at the predetermined forward tilt-out position, the bottom platform having at least one rear foot for supporting the rear of the washer and horizontally securing it to the base in the upright washing position, and a biased hinge connected between the housing and the base to provide torsion for urging rotation of the washer towards the upright washing position for engaging the foot against the base. The washer is adapted for installation underneath a stationary partition such as defined by a stacked dryer or a countertop which limits access for top loading in the upright washing position. More specifically, the washer can be tilted forward for loading and unloading but is still stable in its upright position so as to tolerate spin cycle vibrations.

BRIEF DESCRIPTION OF THE DRAWINGS

The foregoing objects and advantages of the invention will be more fully understood by reading the description of the preferred embodiment with reference to the drawings wherein:

FIG. 2 depicts washer 14 tilted forward to its open position thereby providing access to basket 17 within tub 16 (FIG. 4) for loading and unloading clothes. In operation, clothes are placed into basket 17 and, after detergent is added, washer 14 is returned to the upright position as shown in FIG. 1. Control panel 18 is then used to initiate washing cycles. For example, water is pumped into tub 16 and then agitator 20 provides washing agitation. Next, washer 14 would typically go through appropriate rinse and spin cycles. Many washing machine parts such as a motor, a transmission, pumps, hoses, and tub support apparatus are not shown in this or subsequent mechanical views because they are conventional and a detailed description of them is not necessary for an understanding of the invention.

Figure 2:
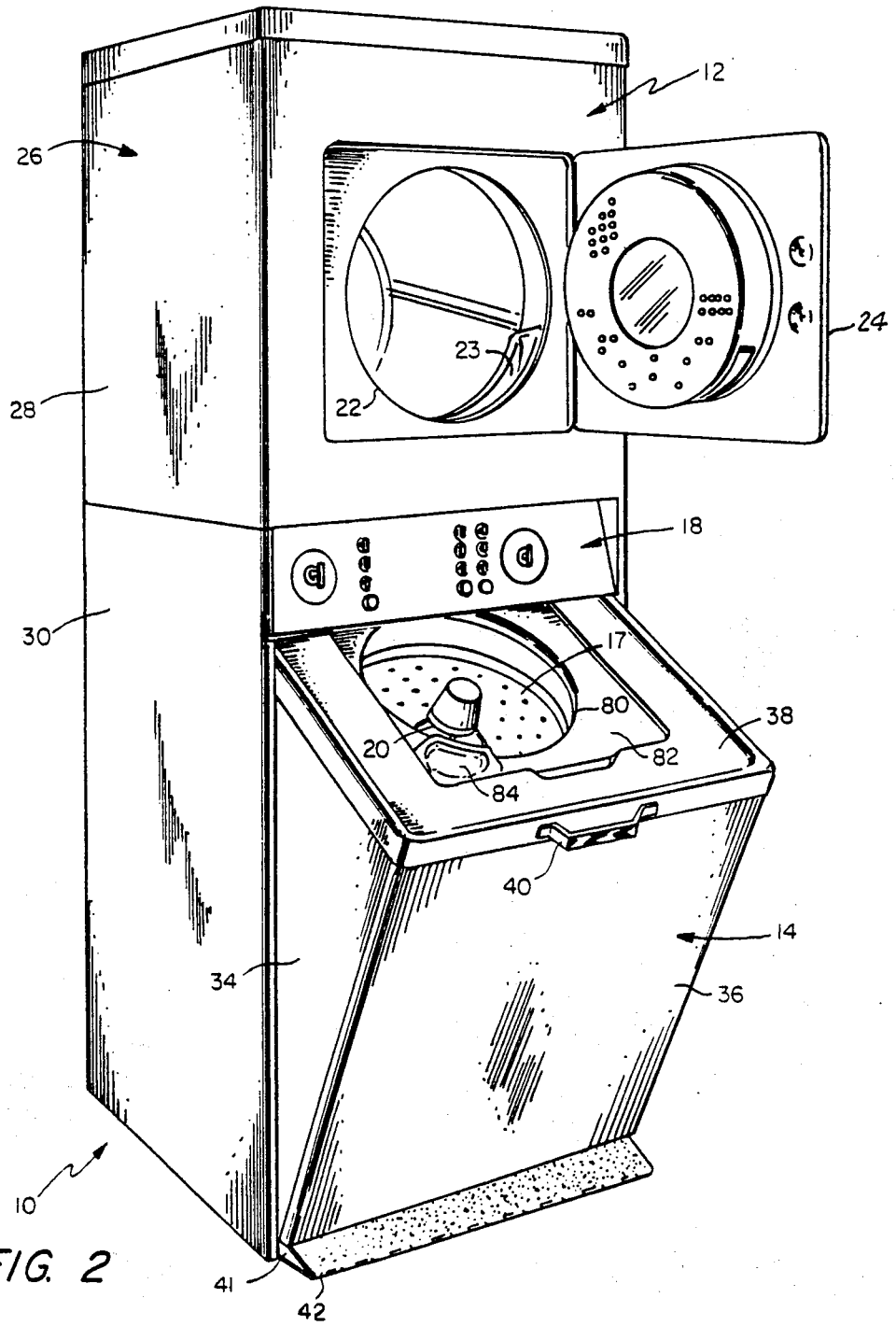
FIG. 2 is the combination of FIG. 1 with the washer tilted forward.

After tilting washer 14 to the forward or open position as shown in FIG. 2, the washed clothes are then lifted out and placed up into dryer 12 through opening 22. After door 24 is closed, control panel 18 is used to control dryer 12 through a drying cycle. Dryer 12 may be of any suitable conventional design. Preferably, opening 22 is near the bottom of dryer 12 so that the operator does not have to lift the clothes higher than necessary. As an alternative to designing a dryer 12 having an opening 22 near the bottom of its chassis, it may be preferable to use a conventional dryer having a high opening and invert the unit to place the opening near the bottom. In such case, it may be desirable to relocate the lint filter 23 and associated duct (not shown).

Figure 1:
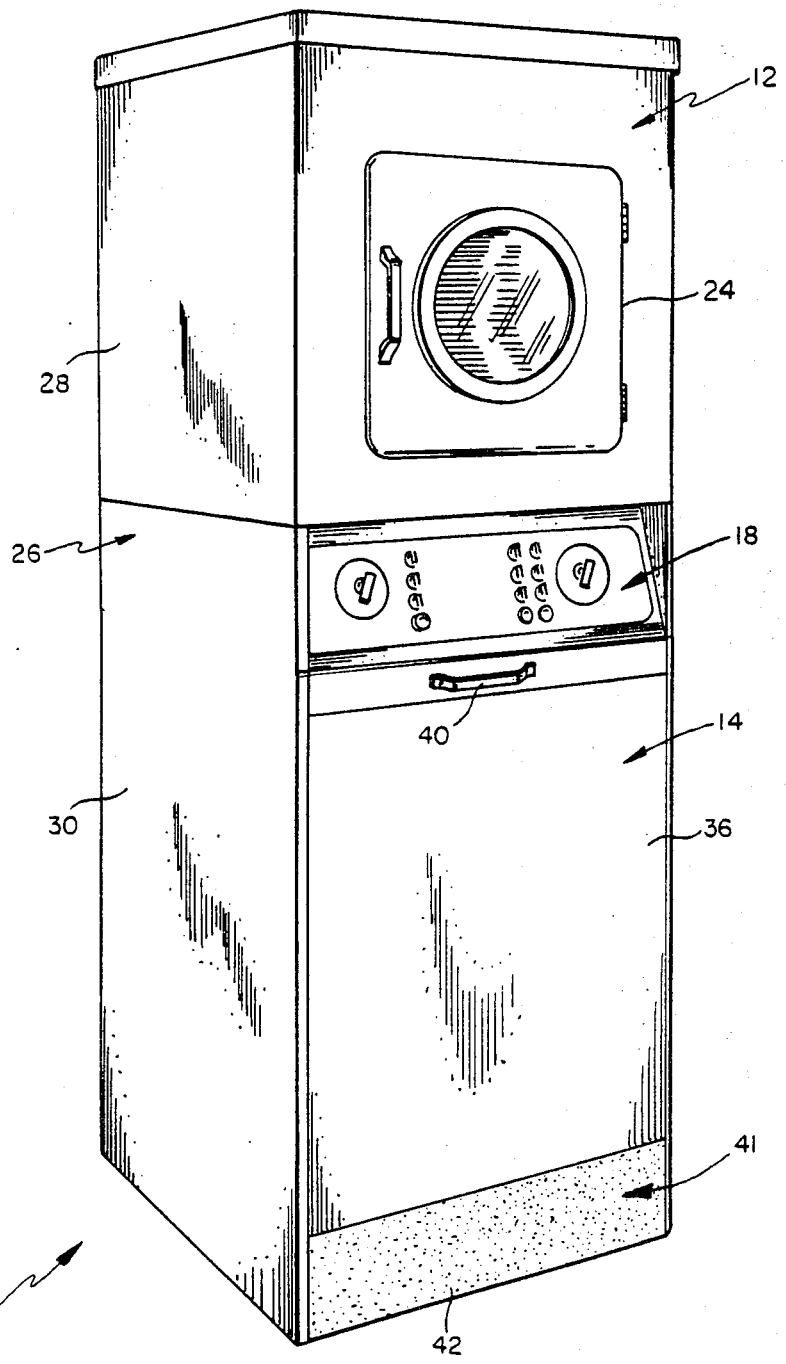
FIG. 1 is a perspective view of a stacked clothes washer and dryer combination.

Outer casing 26 here includes side panels 28 and 30. Panel 28 functions as the outer cabinet for dryer 12. However, washer 14 can tilt forward so it has its own side cabinets 34 while side panel 30 functions to encase washer 14 and provide support for dryer 12. Washer 14 also has a front cabinet 36 and top cabinet 38. It is unnecessary for washer 14 to have a rear cabinet because the back of washer 14 is permanently encased by back panel 39 (FIG. 4) of outer casing 26. Handle 40 is rigidly connected to the front of top cabinet 38 and is used to tilt washer 14 from its upright or closed position as shown in FIG. 1 to its forward or open position as shown in FIG. 2, and vice versa. As will be described in detail later herein, the bottom front of washer 14 is truncated and cover flap 42 functions to cover the truncation 41. Cover flap 42 is flexible such as rubber so that it bends outward when washer 14 is tilted forward as shown in FIG. 2.

Figure 3:
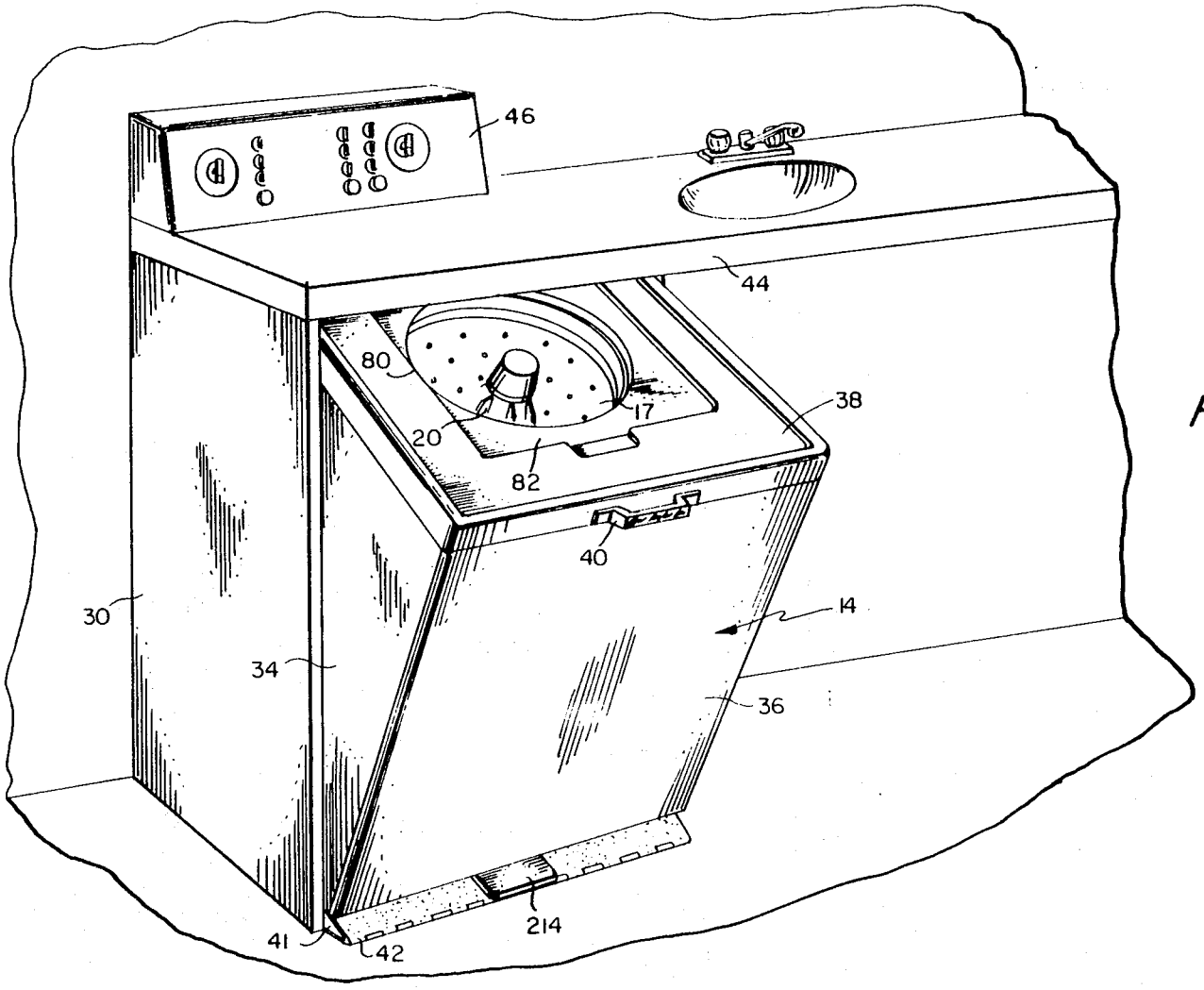
FIG. 3 is a tiltable washer under a countertop.

Referring to FIG. 3, an alternate embodiment or application for a tiltable washer is shown. More specifically, washer 14 is positioned below countertop 44 and is operated using wall mounted control panel 46. Also, washer 14 in FIG. 3 is shown with a foot pedal 214 used in providing a downward force to assist in tilting washer 14 forward.

Figure 4:
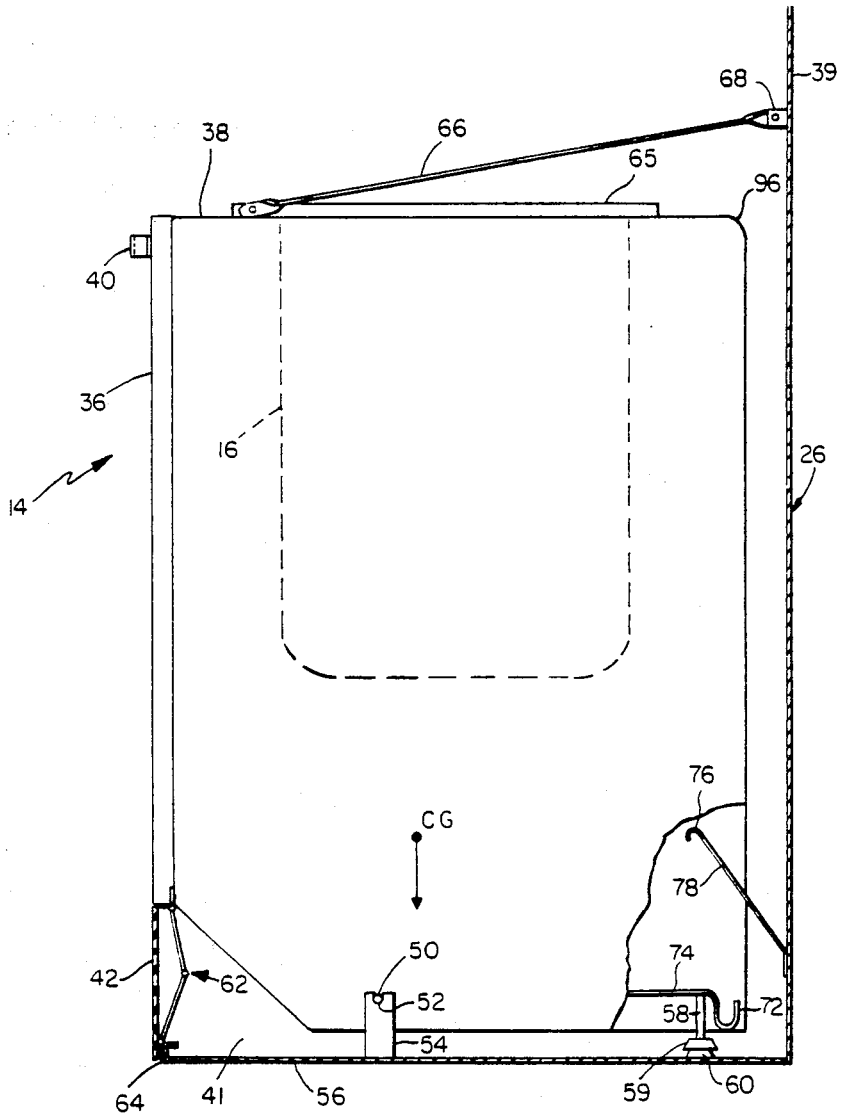
FIG. 4 is an illustrative side view of the washer in an upright position.
Figure 5:
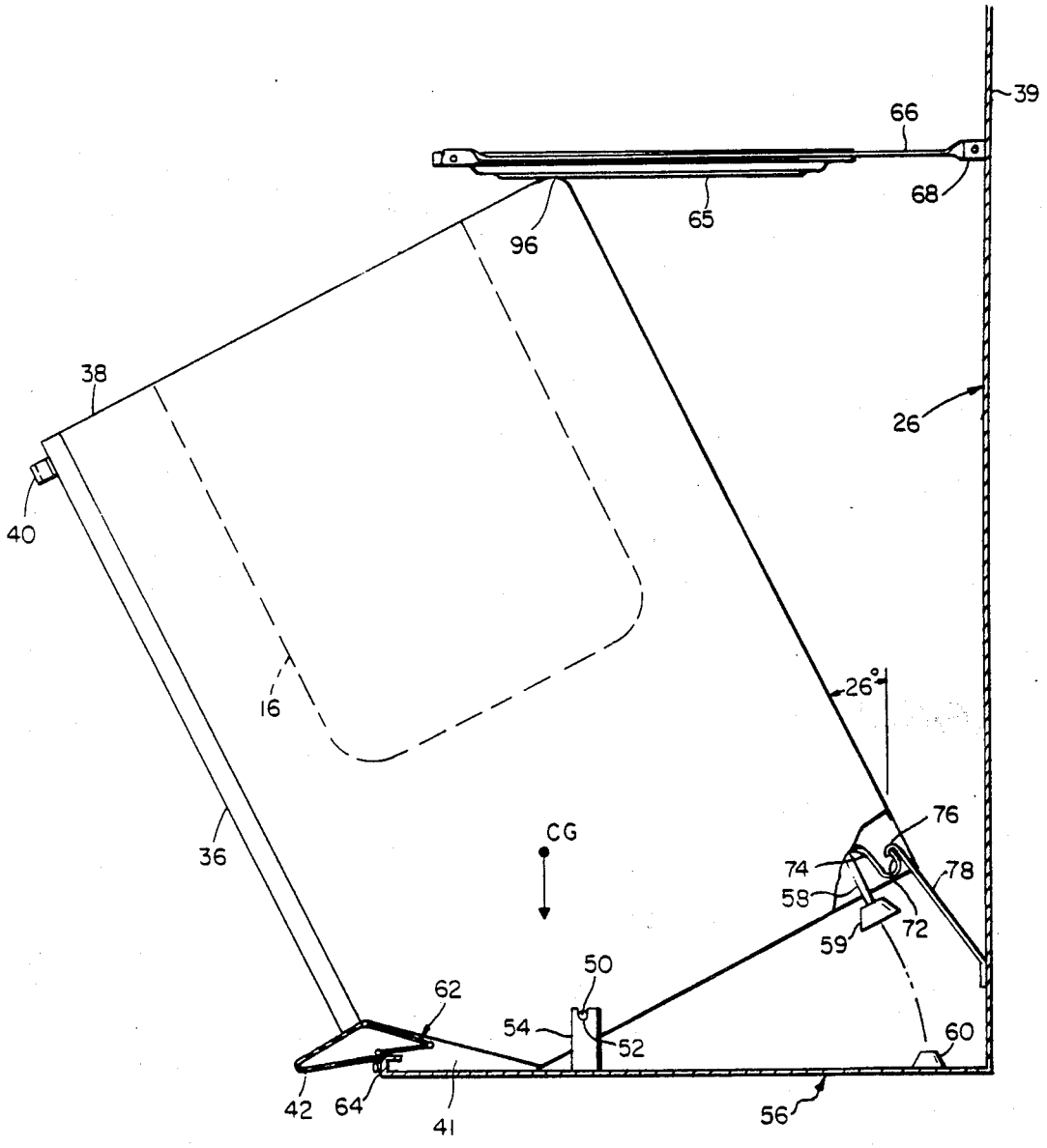
FIG. 5 is an illustrative view of the washer tilted forward.

Referring to FIGS. 4 and 5, illustrative side views of washer 14 in the upright and then forward positions are respectively shown. For illustration, side panel 30 is removed, washer 14 is partially broken away, and structural detail to be described later herein is omitted. Washer 14 is pivotally supported by cylindrical pivot pins 50 extending laterally from the sides of washer 14 from a point in front of the center of gravity CG of the washer 14 in its upright position and behind the truncation 41 of the bottom front as shown in FIG. 4. Pivot pins 50 on each side are axial and define a horizontal axis of rotation as they seat in grooves 52 of pivot support members 54 which are part of base 56. Pilot legs 58 connected to washer 14 have feet 59 with hollows 61 (FIG. 9) that insert over truncated conical pedestals 60 in the upright washing position as shown in FIG. 4. Feet 59 not only provide support for the rear of washer 14 in this position, but they also locate the washer and horizontally secure it to base 56. Toggle hinge 62, which will be described in more detail later herein, connects from the front of washer 14 above truncation 41 to the front 64 of base 56. Toggle hinge 62 is biased to provide an upward force on the front of washer 14 to resist the forward tilting of washer 14 to the position as shown in FIG. 5. More specifically, biased toggle hinge 62 exerts a backward torque on washer 14 which, in the upright position as shown in FIG. 4, firmly anchors feet 59 down on pedestals 60. Accordingly, in the upright position, a significant portion of the weight of washer 14 is carried by biased hinge 62 and feet 59 resulting in washer 14 being sufficiently stabilized so as to effectively limit movement and vibration which is particularly important during a high torque spin cycle. Typically, washer 14 may weight approximately 200 pounds. Washer lid 65 seats on top cabinet 38 when washer 14 is in its upright or closed position as shown in FIG. 4. The forward ends of arms 66 are pivotally connected to the respective sides of lid 65 near its front. The backward ends of arms 66 are pivotally connected to bracket 68 mounted to back panel 39 of outer casing 26.

Handle 40 is used to pull the top of washer 14 forward thereby effecting tilting about the horizontal rotational axis defined by pivot pins 50 and grooves 52. Initially, the force applied to handle 40 must both raise the center of gravity CG of washer 14 which is behind the rotational axis and overcome the upward torque force exerted on the front of washer 14 by biased toggle hinge 62. When the center of gravity of washer 14 is over pivot pins 50, the only force required to continue the forward tilting of washer 14 is that which is necessary to overcome biased toggle hinge 62. Then, when the center of gravity moves in front of pivot pins 50, the weight of washer 14 works to overcome biased toggle hinge 62. Finally, in a predetermined forward tilt position such as 26° as shown in FIG. 5, the rear lip 72 of the washer bottom platform 74 raises in an arc and engages a stop or hook 76 thereby preventing further rotation about pivot pins 50. Hook 76 which may have a noise dampening sheath 73 (FIG.8) is connected by neck 78 to the back of base 56. During movement of washer 14 from its closed postition as shown in FIG. 4 to its open position as shown in FIG. 5, the upward rotational arc of top cabinet 38 pushes lid 65 upward by sliding engagement because lid 65 is not attached by conventional means such as a hinge to top cabinet 38 and arms 66 prevent lid 65 from moving forward with top cabinet 38. Accordingly, lid 65 automatically opens when washer 14 is tilted forward thereby simplifying loading and unloading through washer top access opening 80.

Figure 6:
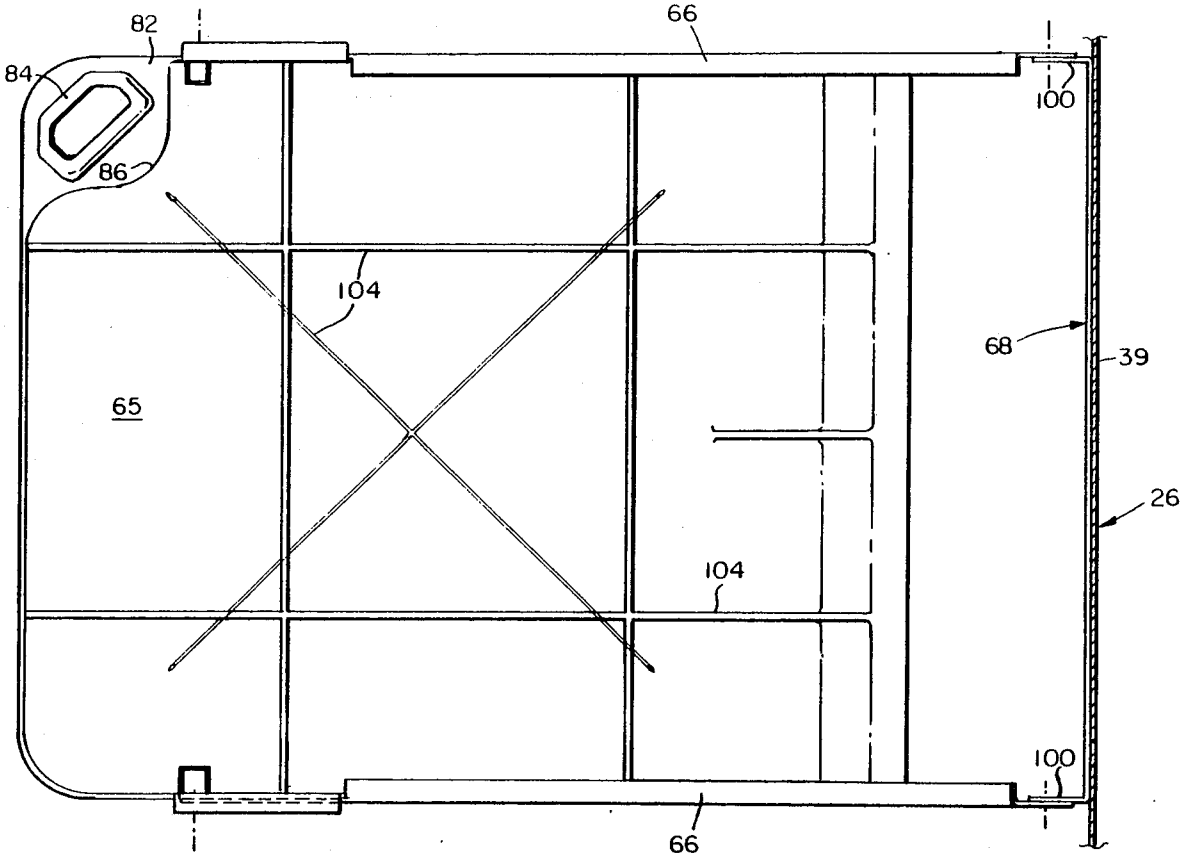
FIG. 6 is a top view of the washer lid.
Figure 7:
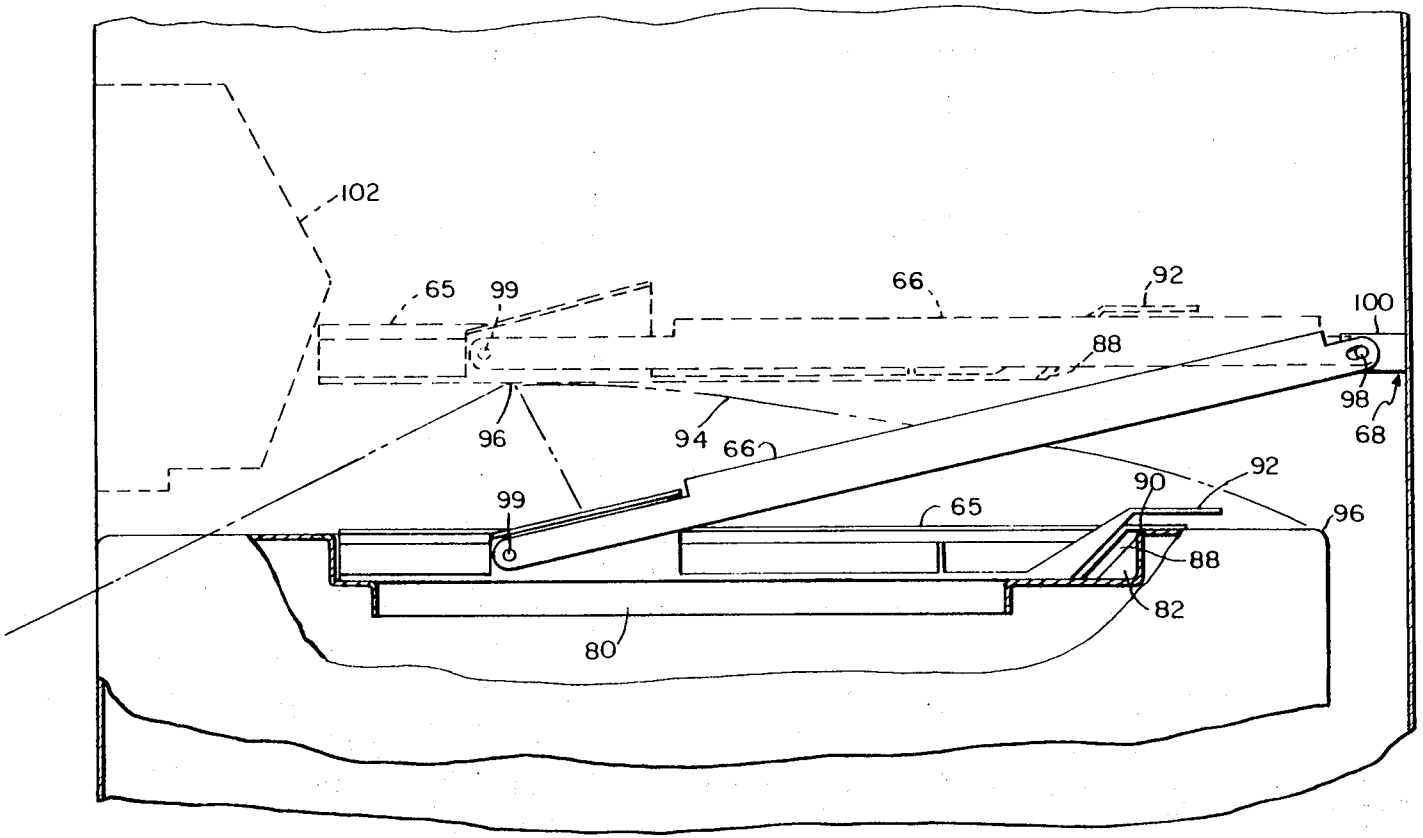
FIG. 7 is a side view of the washer lid.

Referring to FIGS. 6 and 7, respective top and side detailed views of washer lid 65 are shown. Washer lid 65 seats into top cabinet recess 82 which surrounds the washer top access opening 80. Typically, recess 82 may include a conventional bleach dispenser 84 that is slightly raised above the bottom surface of recess 82. Because lid 65 slides into place in recess 82 rather than the conventional approach of rotating downward about hinges, lid 65 has a corner notch 86 conformed to dispenser 84. In FIG. 7, lid 65 is in the solid line position when washer 14 is in the closed or upright position. Lid 65 is preferably sloped on the rear underside 88 so that it doesn't bind when being lifted by the top edge 90 of recess 82 when washer 14 is tilted forward about pivot pins 50. Lid 65 has a rim 92 which extends rearwardly above top cabinet 38 outside recess 82. The function of lid 65 is to prevent water and suds from splashing out of the tub 16 in an agitate cycle. For this purpose, it is only necessary that lid 65 cover opening 80; there is no need to have a tight fit within recess 82. In FIG. 7, lid 65 is in the dotted line position after it has been raised by the opening or forward tilting of washer 14. More specifically, line 94 shows the arc of the rear corner 96 of washer 14 as it is tilted about the rotational axis of pivot pins 50. As lid 65 is restrained from moving forward out from under dryer 12 or countertop 44 by arms 66, either edge 90 or corner 96 of washer 14 supports lid 65 and arms 66 and pushes them upward in sliding engagement as the washer is rotated. More specifically, U-shaped bracket 68 is connected to the back panel 39 of outer casing 26 by suitable means such as screws. A pivot fastener 98 connects the rear ends of arms 66 to the outward extending hands 100 of bracket 68. Arms 66 are connected by pivot fasteners 99 to the sides of lid 65 near its front and are lateral thereto so that in its raised position as shown by dotted lines in FIG. 7, lid 65 rises between arms 66. In such position, lid 65 is supported by the rear corner 96 of top cabinet 38. As shown, lid 65 in its raised position clears the back of controls 102 of control panel 18. As an alternate embodiment to arms 66, the forward motion of lid 65 could be restrained by suspending it from the underside of dryer 12 with cables.

Lid 65 is made of plastic such as polypropylene. In this embodiment where lid 65 is detached from the top cabinet 38 and is removed from opening 80 by sliding engagement with top cabinet 38, plastic has the advantage of being light-weight thereby reducing the friction between it and top cabinet 38. Also, plastic has self-lubricating properties to provide quiet operation. More specifically, if a conventional metal lid were used, it might create a grinding noise during sliding engagement with top cabinet 38 and cause a clank as it dropped into recess 82 during closing. Ribs 104 make lid 65 more rigid.

Figure 9:
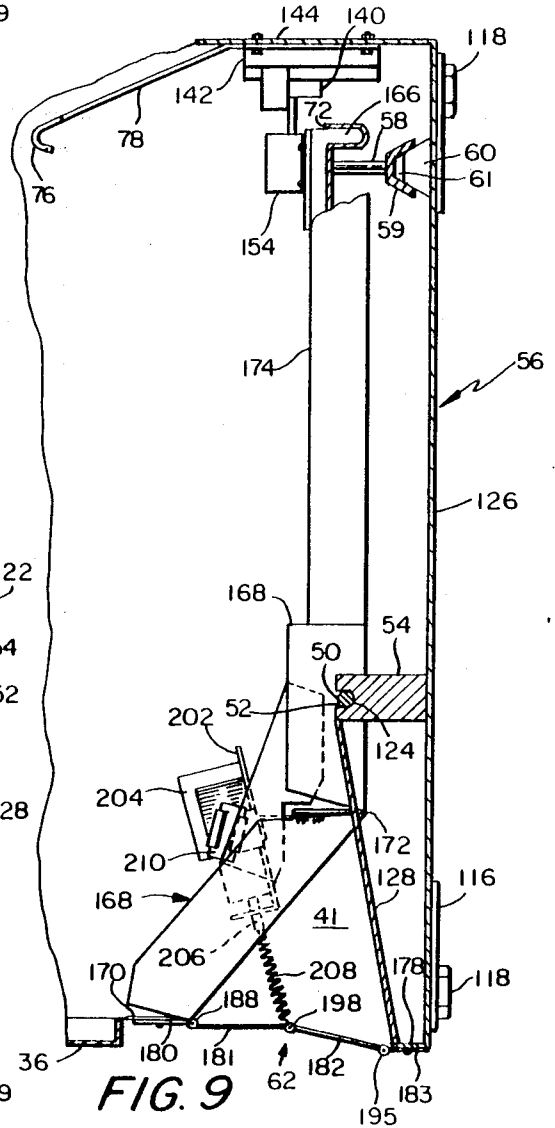
FIG. 9 is a view taken along 9—9 of FIG. 8.
Figure 8:
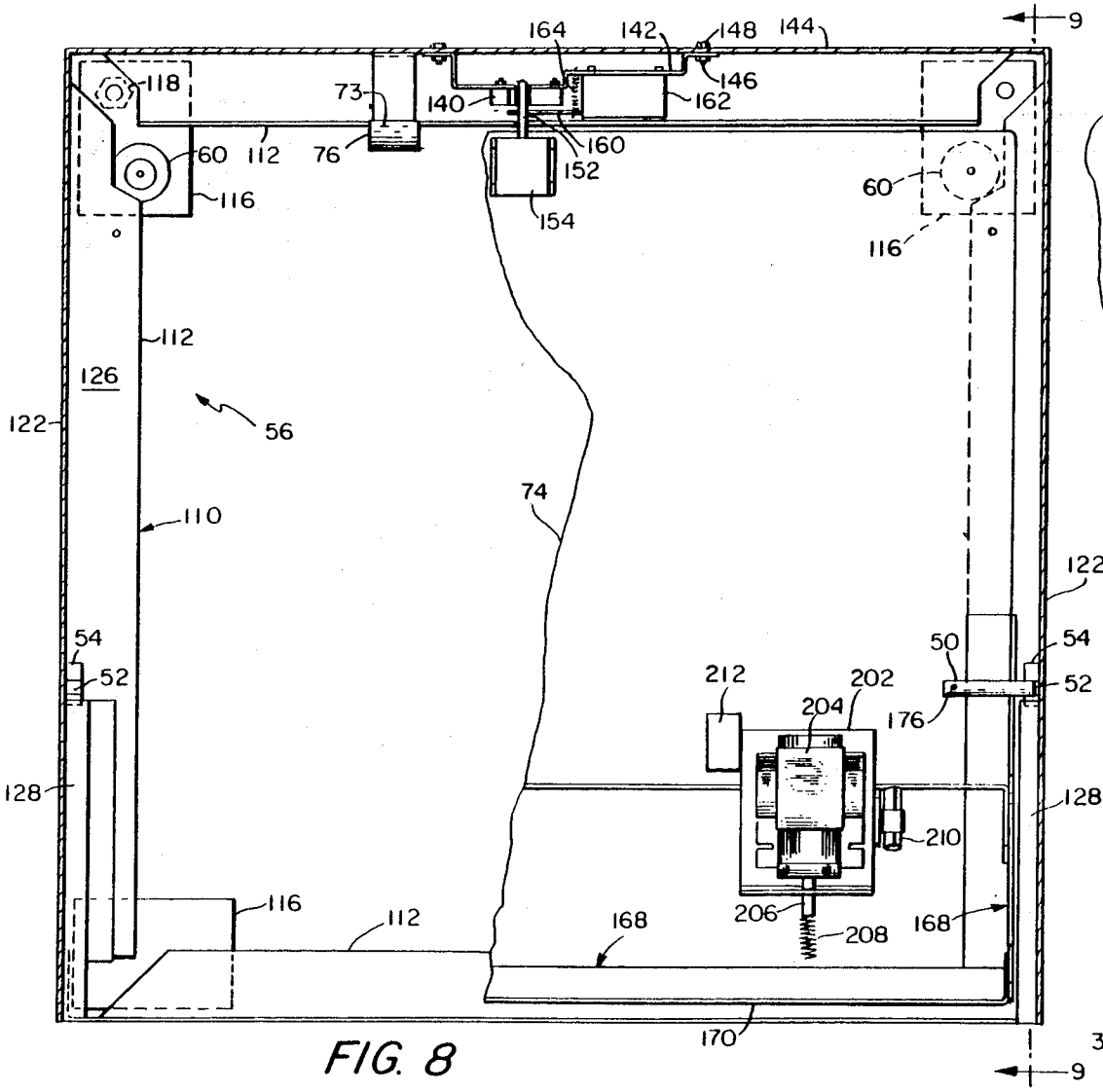
FIG. 8 is a top view of the washer base and a portion of the washer bottom platform.

Referring to FIG. 8, a top view of base 56 and a portion of the bottom platform 74 of washer 14 is shown including structure and details not depicted in FIGS. 4 and 5. FIG. 9 is a view taken along line 9—9 of FIG. 8. Base 56 is a sturdy support structure here defining a frame 110 having peripheral angle iron segments 112 connected by suitable means here welds to steel corner plates 116. Floor stands 118 mounted to the underside of plates 116 are adjustable for leveling. Rugged truncated conical pedestals 60 ar securely attached by suitable means such as countersunk bolts (not shown) to the back plates 116. Feet 59 on pilot legs 58 have hollows 61 which align with and conform to pedestals 60. In the closed position of washer 14, hollows 61 receive pedestals 60 thereby horizontally securing washer 14 to base 56 to provide stability which is of great significance in the spin cycle. Pedestals 60 are fabricated of a hard, low-friction, noise dampening material such as plastic, or more particularly, nylon. Accordingly, there is no loud clank as feet 59 are firmly lowered onto pedestals 60. Also, vibration noises such as would occur during a spin cycle are minimized. As an example, the dimensions of base 56 may be approximately 27 inches square so that it will enclose and support a full size or large capacity washer 14. Approximately 9 inches back on each side of base 56 along side rails 122 are opposite pivot support members 54 which define axially aligned grooves 52. The cylindrical bottoms 124 of grooves 52 may be approximately 2 inches above the bottoms of slats 126 of base 54. Sloped tracks or ramps 128 connected along the side rails 122 between pivot support members 54 and the front of base 56 are used to support the pivot pins 50 while sliding washer 14 into or out of outer casing 26 for installation or repair.

Figure 10:
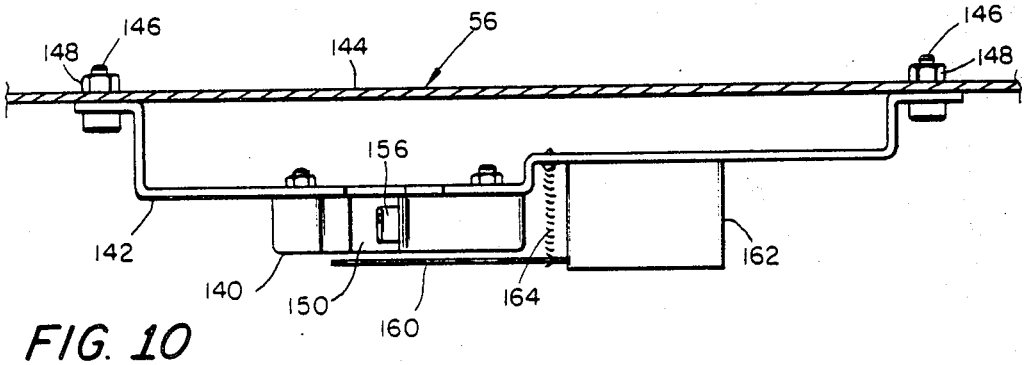
FIG. 10 is a top view of the washer latch.
Figure 11:
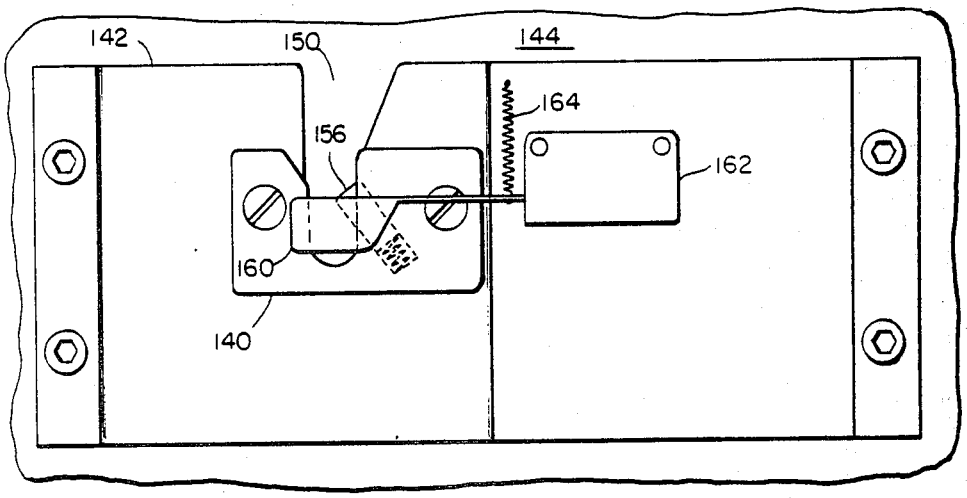
FIG. 11 is a front elevation view of the washer latch.
Figure 12:
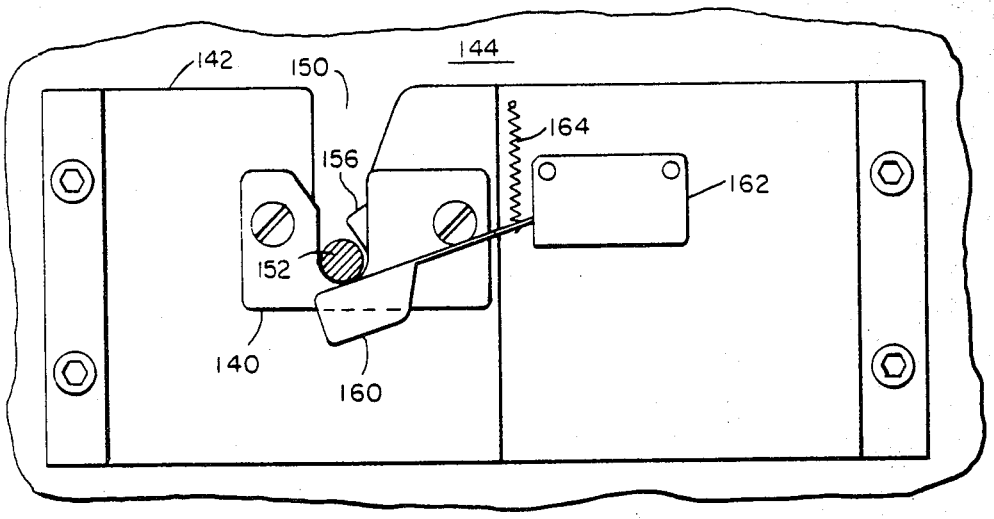
FIG. 12 is an alternate operational view of FIG. 11.

Still referring to FIGS. 8 and 9, latch 140 is connected to bracket 142 which is securely mounted to back rail 144 of base 56. More specifically, bracket 142, here connected to rail 144 by nuts 146 and bolts 148, spaces latch 140 away from back rail 144. An expanded top view of latch 140 and bracket 142 is shown in FIG. 10; expanded front elevation views are shown in FIGS. 11 and 12. Throat 150 of latch 140 is adapted for receiving a downward forced shaft, here plunger 152 of latch solenoid 154. More specifically, spring-loaded stop or tongue 156 permits lowering of plunger 152 but then locks plunger 152 to prevent its upward movement. Latch solenoid 154 is securely connected to the back of washer bottom platform 74 with cylindrical plunger 152 extending out over back lip 72 aligning so as to be received in throat 150 when washer 14 is in the upright position as shown in FIG. 1. More specifically, when washer 14 is tilted backward from its open position, plunger 152 drops into throat 150 pushing tongue 156 out of the way until plunger 152 moves to its downward position as shown in FIG. 12. There, tongue 156 snaps back engaging or locking washer 14 in its upright washing position. Accordingly, washer 14 is secured in its support position on pivot pins 50, pilot legs 58 and biased toggle hinge 62. Paddle 160 extending from latch switch 162, here a microswitch, is urged by spring 164 upward to cover the front of throat 150 as shown in FIG. 11. When plunger 152 drops down in throat 150 as shown in FIG. 12, plunger 152 depresses paddle 160 thereby altering the state of latch switch 162; the function of this will be described later herein. Also, as will be described, the release of the latching function is initiated by energizing latch solenoid 154 thereby retracting plunger 152. When plunger 152 is horizontally withdrawn from throat 150, paddle 160 is urged upward to the position shown in FIG. 11 thereby preventing the reentry of plunger 152 into throat 150 in a horizontal direction even though latch solenoid 154 may be deenergized.

Washer bottom platform 74 has an outer trough 166 around the back and sides to make the structure more rigid. Other indentations and contours used for mounting apparatus such as for tub 16 are not shown as they form no part of the invention. The front of what would otherwise be a conventional washer bottom platform is omitted and connected by suitable means such as welds in its place is truncation angle frame 168. As an example, the distance from the front 170 of truncated angle frame 168 to the back of washer bottom platform 74 may be approximately 24 inches with the height and depth of truncation 41 being approximately 5 inches and 6 inches, respectively. From the bottom 172 of truncation 41, the pivot pins 50 may preferably be about 8 inches towards the rear and truncation angle frame 168 may extend back past them to provide increased structural strength. Pivot pins 50 therefore attach to the washer bottom platform 74 inside troughs 166 and extend outward through holes in side lips 174 and angle frame 168. The axis of rotation defined by pivot pins 50 may be approximately 0.80 inches above the bottom of troughs 166. Pivot pins 50 are securely attached to washer bottom platform 74 by suitable means, here bolts 176. Side cabinets 34 which are not shown in FIG. 9 attach to the outside of side lips 174 of washer bottom platform 74 and also have a truncated front conforming to angle frame 168.

Figure 13:
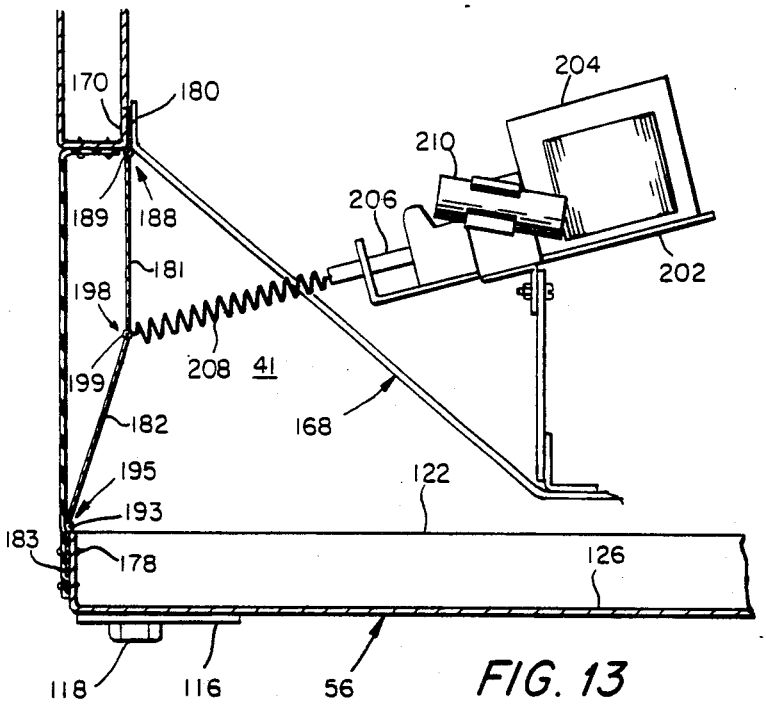
FIG. 13 is a side view of the biased hinge.
Figure 14:
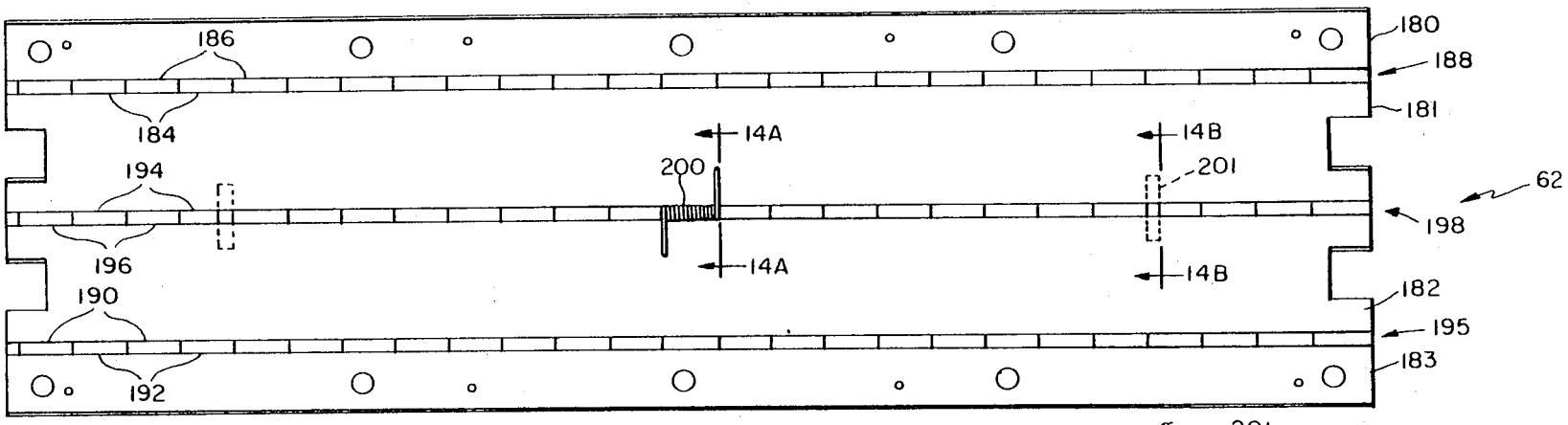
FIG. 14 is a front view of the biased hinge.
Figure 14B:
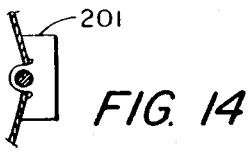
FIGS. 14*a* and 14*b* are side views taken along lines 14*a*—14*a* and 14*b*—14*b*, respectively.
Figure 14A:
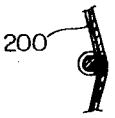

As briefly described earlier herein and as shown best in FIGS. 13 and 14, biased toggle hinge 62 connects from the front 170 of angle frame 168 of washer 14 to the front rail 178 of base 56. More specifically, biased toggle hinge 62 here consists of four lateral metal plates 180–183. Plate 180 is horizontally secured to front 170 of angle frame 168. The bottom of plate 180 has knuckles 184 which mate with nuckles 186 of plate 181 to form hinge joint 188 using rod 189. Similarly, plate 183 is horizontally secured to the front rail 178 of base 56 and its top has knuckles 190 which mate with knuckles 192 of plate 182 to form hinge joint 195 using rod 193. Further, knuckles 194 and 196 of plates 181 and 182 mate to form hinge joint 198 using rod 199. At least one of knuckles 194 or 196 is omitted and torsion spring 200 is inserted around rod 199 in its place. Torsion spring 200 urges plate 180 toward clockwise rotation as shown in FIG. 13 thereby putting a backward and upward force on washer 14 as described earlier herein. FIG. 14A shows a side view of torsion spring 200. FIG. 14B shows a side view of stop 201 which restricts the angle to which joint 198 can bend in one direction.

Shelf 202 is mounted to angle frame 168 as shown best in FIG. 13. Tilt-out assist solenoid 204 is affixed to shelf 202 and has plunger 206 directed towards hinge joint 198. A spring 208 is connected between plunger 206 and hinge joint 198 thereby providing a backward force on hinge joint 198 partially counteracting the torsion put on hinge joint 198 by torsion spring 200. As will be described later herein, energizing tilt-out assist solenoid 204 retracts plunger 206 thereby increasing the tension in spring 208. Accordingly, the pull force on handle 40 required to raise the center of gravity of washer 14 and overcome the torque of torsion spring 200 is thereby reduced. In short, by energizing tilt-out assist solenoid 204, it becomes easier to pull washer 14 to the open position as shown in FIG. 2. Mercury switch 210 is mounted adjacent to shelf 202. The state of mercury switch 210 is determined by the tilt angle of washer 14; its function will be described later herein. Also, tilt-out assist relay 212 is mounted on or near shelf 202; its function will also be described later.

Figure 15:
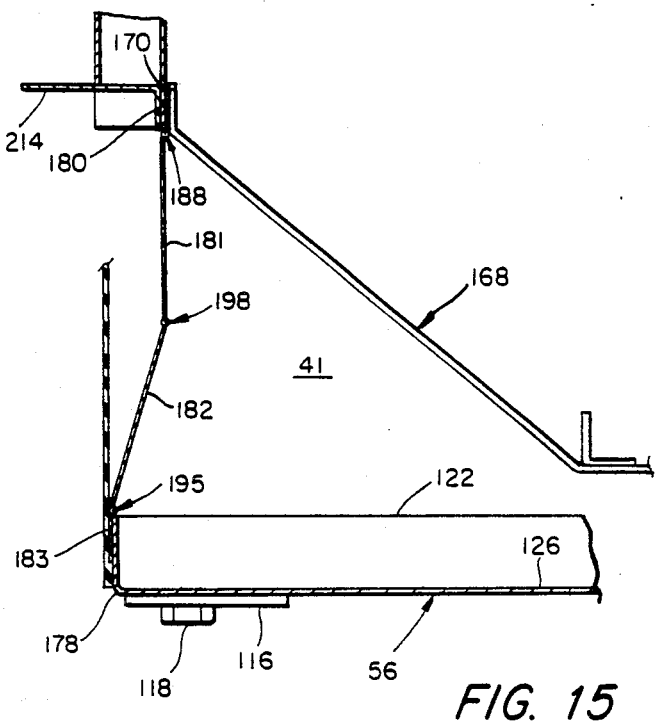
FIG. 15 is an alternate embodiment of FIG. 13.

As described earlier, it is important that tiltable washer 14 be stable in its upright washing position so as to minimize movement and vibration during washing cycles and particularly during a spin cycle. Further, it is important that an operator be able to tilt washer 14 forward and backward without using excessive force. These two objectives, however, are not totally compatible. With regard to stability, feet 59 carry the rear weight of washer 14 and horizontally secure it to base 56. Feet 59 firmly seat on pedestals 60 because the center of gravity CG of washer 14 is between feet 59 and the horizontal rotational axis defined by pivot pins 50 and because biased toggle hinge 62 urges rotation of washer 14 in a backward direction. For example, the center of gravity CG as indicated in FIG. 4 may preferably be more than an inch behind the rotational axis when washer 14 is in the upright washing position. It is noted that in modifying a conventional washer so as to have truncation 41, washer parts such as a motor or pumps may need to be relocated on bottom platform 74 and in so doing, the center of gravity CG can be optimally changed with respect to a selected rotational axis. Locating the center of gravity as described and providing torsion in biased toggle hinge 62 results in feet 59 and hinge 62 carrying a significant part of the weight of washer 14. Accordingly, it was found that stability during a spin cycle could be attained without using a locking device such as an over-center locking hinge. It is noted that latch 140 is used to prevent manual tilting of washer 14 and does not function as a spin cycle absorbing lock; in fact, if latch 140 were integrally used to assist in spin cycle stabilization, it would produce excessive noise and would wear. In the described embodiment, it was found that without tilt-out assist solenoid 204, a force of approximately 18–20 pounds was required on handle 40 to initiate forward tilting of washer 14. To reduce this pull-out force, tilt-out assist solenoid was added and it was found that the pull-out force was reduced to approximately 6 or 8 pounds. For example, tilt-out assist solenoid 204 with a pull-in force of approximately 20 pounds is used to exert a 14-pound backward force on hinge joint 198. In the described embodiment where washer 14 is tilted forward approximately 26° or 27°, the force required to close washer 14 was slightly larger than the pull-out force, but this was considered acceptable because it is generally easier for the operator to obtain leverage to close the washer. Referring to FIG. 15, an alternate embodiment of FIG. 13 is shown. More specifically, in lieu of tilt-out assist solenoid 204, foot pedal 214 is provided and the operator may use it to assist in providing the required pull-out force.

Figure 16:
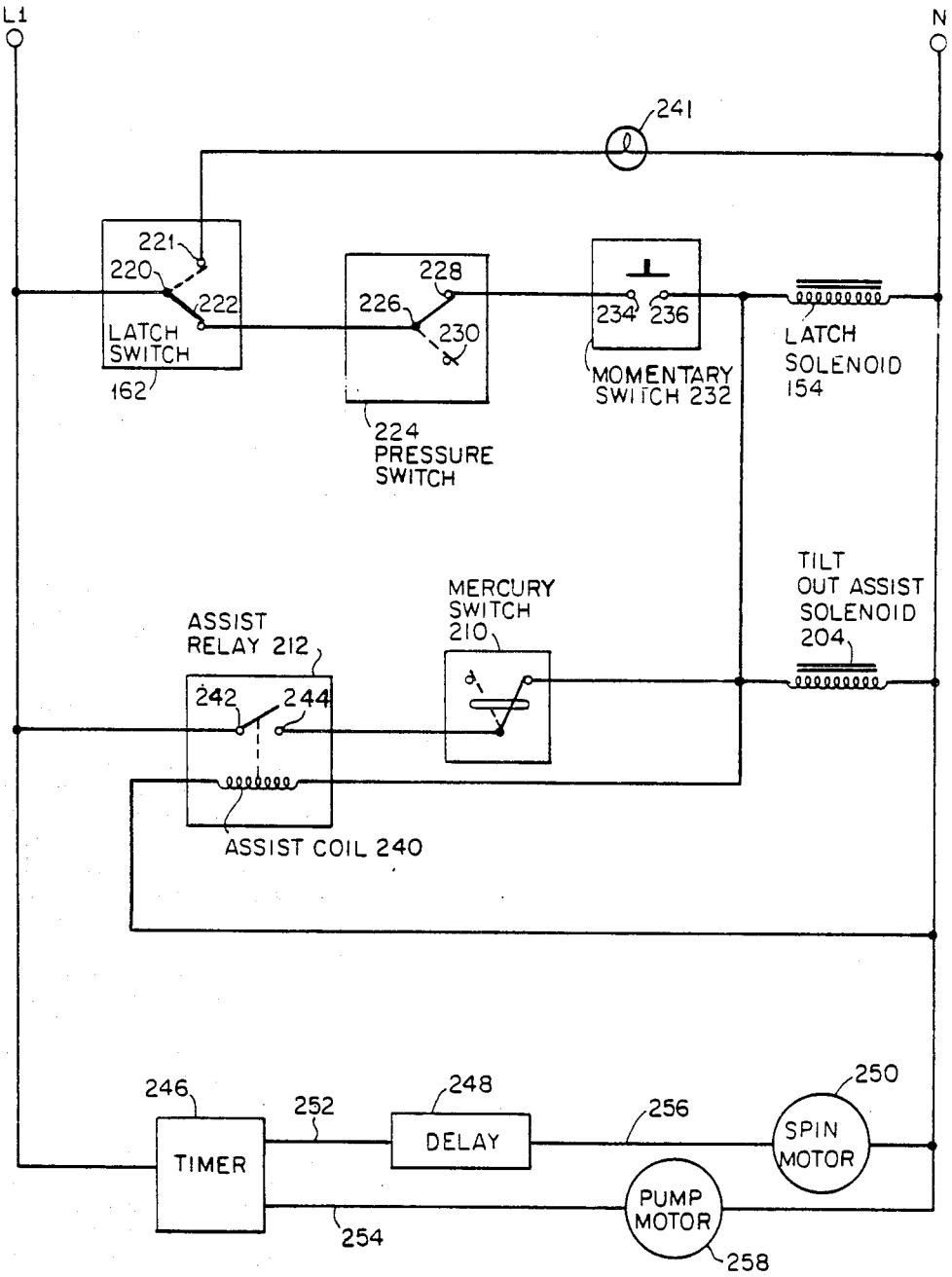
FIG. 16 is a schematic of the washer control.

Referring to FIG. 16, a schematic of the control of washer 14 is shown. As is conventional, N identifies the neutral line and L1 identifies a 110 volt single phase line. As described earlier, latch switch 162 has a paddle 160 which is urged by spring 164 to a position where it covers throat 150. When the washer 14 is upright and the plunger 152 of latch solenoid 154 extends into the throat 150 of latch 140, paddle 160 is pushed downward and contact 220 is connected to contact 222 as indicated by the solid line. Conventional single level pressure switch 224 is connected to tub 16. When the water level is below a predetermined level such as, for example, 3 inches, contact 226 of pressure switch 224 is connected to contact 228 as shown by the solid line. If there is a greater pressure on pressure switch 224 indicative of there being more than the predetermined level of water in tub 16, then pressure switch 224 is open as defined by contact 226 being connected to contact 230 as indicated by the dotted line. Momentary push button switch 232 on control panel 18 is activated by the operator to tilt washer 14 to its open position. Provided plunger 152 is locked in latch 140 and there is less than the predetermined level of water in tub 16, connecting contacts 234 and 236 of momentary switch 232 provides 110 volts AC across latch solenoid 154. Energizing latch solenoid 154 causes plunger 152 to be withdrawn from latch 140. Accordingly, as the latching function of latch 140 is released, paddle 160 is urged upward by spring 164 and then, even if latch solenoid 154 is deenergized, plunger 152 is prevented from reentering throat 150 of latch 140 by paddle 160. Paddle 160 moving to the position in front of throat 150 as shown in FIG. 11 also cause contact 220 in latch switch 162 to be connected to contact 221 as indicated by the dotted line thereby placing 10 volts AC across tub light 241 turning it on. Simultaneous to latch solenoid 154 being energized, tilt-out assist solenoid 204 is energized and current also flows through assist coil 240 of tilt-out assist relay 212. As described earlier, the retraction of plunger 206 of tilt-out assist solenoid 204 provides greater tension on spring 208 thereby reducing the force on handle 40 that is required to tilt washer 14 forward to the open position. Current flowing through assist relay coil 240 of tilt-out assist relay 212 causes normally open contacts 242 and 244 to close. Because mercury switch 210 is closed because washer 214 is in an upright position, 110 volts AC continues to be provided to tilt-out assist solenoid 204 and tilt-out assist coil 240 even though the circuit through latch switch 162 and momentary switch 232 is broken by either paddle 160 moving to its upward position or momentary switch 232 being released. Accordingly, current continues to activate latch solenoid 154 and tilt-out assist solenoid 204 until washer 14 is tilted to some predetermined rotation, here 14°, at which time mercury switch 210 opens thereby breaking the circuit therethrough.

Washer timer 246 is of conventional design and is used to control various washing cycles. In a conventional washer, the pumping of water out of the tub and the spinning operation are generally initiated simultaneously. As shown in FIG. 16, however, delay 248 is connected between spin motor 250 and conventional timer 246 so that even though signals are output on lines 252 and 254 calling for simultaneous spinning and pumping, the signal on line 256 to the spin motor is delayed until most of the water is pumped out of tub 16. For example, delay 248 may provide a delay of approximately one minute between the time that pump motor 258 starts and spin motor 234 is activated. At an illustrative pumping rate of 10.5 gallons per minute, 10.5 gallons would be pumped from tub 16 before the motor for spinning is activated. The reason for pumping water before spinning is that washer 14 does not have an out-of-balance switch. Because of the weight, it would be most difficult and impractical to open washer 14 when it is full of water. In actual practice, the spin operation and the pump are typically driven by the same motor; in such case, motors 250 and 258 in FIG. 16 would designate the couplers between the motor and the respective loads.

Figure 17:
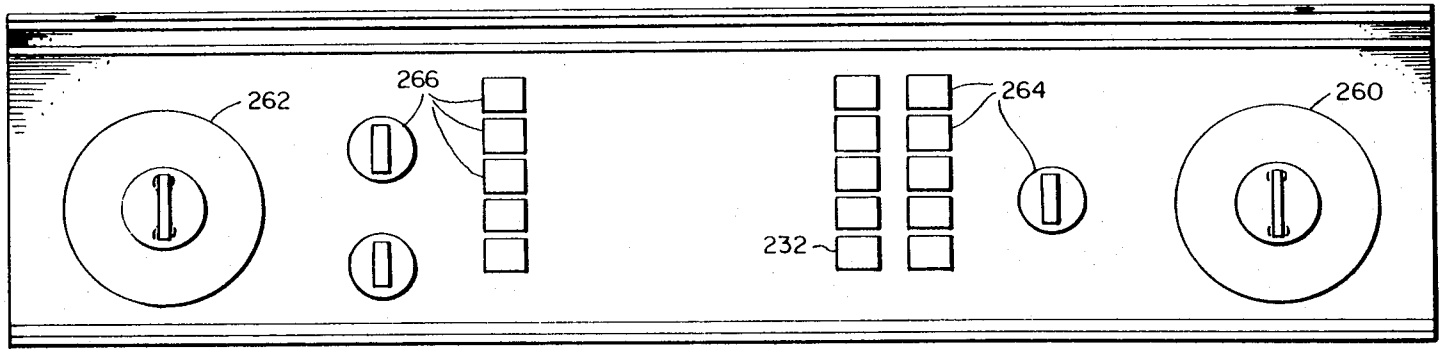
FIG. 17 is the washer control panel. cl DESCRIPTION OF THE PREFERRED EMBODIMENT Referring to FIG. 1, there is shown a clothes washer and dryer combination 10 including a front loading dryer 12 stacked above a top loading washer 14 here depicted in its upright or closed position.

Referring to FIG. 17, a view of control panel 18 is shown. Washer 14 controls are on the right side and dryer 12 controls are on the left side. An illustrative washing and drying operation will be summarized. Initially, washer 14 is assumed to be in an upright position as shown in FIG. 1 with plunger 152 of latch solenoid 154 inserted in the throat 150 of latch 140 thereby preventing washer 14 from being tilted forward. In such state, contact 220 of latch switch 162 is connected to contact 222. When the operator depresses momentary switch 232 closing contacts 234 and 236, latch solenoid 154 is energized provided less than 3 inches of water are in tub 16 so that contacts 226 and 228 of single level pressure switch 224 are connected. If not, the latching or locking function cannot be disengaged by latch solenoid 154 because it is desirable not to have the operator attempt to tilt the washer forward when it is heavy with water. The momentum of opening a washer full of water could tip over washer and dryer combination 10 or could cause water to splash out. Simultaneous to latch solenoid 154 being energized thus deactivating the locking of washer 14, tilt-out assist solenoid 204 is also energized. Tub light 241 is turned on and tilt-out assist solenoid 204 continues to be energized until washer 14 is tilted forward to a point where mercury switch 210 is horizontal at which time mercury switch 210 is opened and tilt-out assist solenoid is deactivated. After loading clothes into basket 17 and detergent added, washer 14 is returned to its upright position where plunger 152 is engaged by tongue 156 in throat 150 thereby locking the washer in the upright washing position. In order to minimize vibrational forces on latch 140, torsion spring 200 continues to urge the rear of washer 14 to seat feet 59 firmly on truncated conical pedestals 60. Controls 264 are used to set desired washing parameters such as water level and temperature. Then, timer control 260 is activated. At the completion of the appropriate agitate and rinse cycles, the water is pumped out of tub 16 for approximately 1 minute before spinning is initiated. Next, following the same procedure for opening washer 14 as described above, the clothes are lifted to dryer 12 for drying. Drying parameters are set by controls 266 and drying timer 262 is activated.

This completes the description of rhe preferred embodiment. For those skilled in the art, the teaching herein will bring to mind many alterations and modifications without departing from the spirit and scope of the invention. Accordingly, it is intended that the scope of the invention be limited only by the appended claims.

What is claimed is:

1. In combination:

a stable base;

a top loading clothes washer pivotally supported on said base wherein said washer is tiltable between an upright washing position and a predetermined forward tilting position used for loading and unloading clothes;

means for limiting said forward tilting at said predetermined forward position, said forward tilting limiting means comprising a hook connected to said base which engages said washer in said predetermined forward position; and means for limiting backward tilting at said upright washing position, said backward tilting limiting means comprising means for horizontally securing said washer to said base in said upright washing position.

2. In combination:

a stable base;

a top loading clothes washer pivotally supported on said base wherein said washer is tiltable between an upright washing position and a predetermined forward tilting position used for loading and unloading clothes;

means for limiting said forward tilting at said predetermined forward position; and means for limiting backward tilting at said upright washing position, said backward tilting limiting means comprising feet connected to said washer which mate with congruent members of said base for horizontally securing said washer to said base in said upright washing position.

3. In combination:

a top loading clothes washer having a front;

a stable base pivotally supporting said washer about an axis of rotation disposed lateral to said washer between said front and the center of gravity of said washer;

said washer comprising means engageable to said base for supporting and horizontally securing the rear of said washer to said base when said washer is in an upright washing position;

said washer being tiltable about said axis in a forward direction; and means for limiting forward tilting of said washer about said axis at a predetermined tilt-out position used for loading and unloading clothes from said washer, said forward tilting means comprising a hook connected to said base which engages said washer in said predetermined tilt-out position.

4. In combination:

a top loading clothes washer having a front;

a stable base pivotally supporting said washer about an axis of rotation disposed lateral to said washer between said front and the center of gravity of said washer;

said washer comprising means engageable to said base for supporting and horizontally securing the rear of said washer to said base when said washer is in an upright washing position, said supporting and horizontally securing means comprising feet connected to said washer which mate with congruent members of said base;

said washer being tiltable about said axis in a forward direction; and means for limiting forward tilting of said washer about said axis at a predetermined tilt-out position used for loading and unloading clothes from said washer.

5. In combination:

a top loading clothes washer having a front;

a base pivotally supporting said washer about an axis of rotation lateral to said washer and in front of its center of gravity;

said washer having rear feet which mate with congruent members of said base when said washer is in an upright washing position, said feet providing rear support for said washer in said upright washing position and horizontally securing said washer to said base; and said base having a hook for limiting forward tilting of said washer about said axis at a predetermined tilt-out position used for loading and unloading clothes from said washer.

6. In combination:

a clothes washer having a cabinet comprising a front, sides, and a top with an opening for loading and unloading clothes, said cabinet having a bottom front truncation;

a stable base pivotally supporting said washer about a horizontal rotational axis lateral to said washer wherein said washer is tiltable between an upright washing position and a predetermined forward tilted position for loading and unloading clothes through said opening;

a hook connected to said base for engaging and limiting forward tilting of said washer at said predetermined forward tilted position;

said washer having rear feet for supporting the rear of said washer in said upright washing position, said feet horizontally securing said washer to said base in said upright washing position; and means for providing a torque force for urging said washer to rotate about said axis in a direction from said predetermined forward tilted position towards said upright washing position to engage said feet on said base in said upright washing position.

7. The combination recited in claim 6 further comprising pedestals connected to said base and congruent hollows in said feet of said washer, said feet being aligned wherein said hollows of said feet seat down over said pedestals in said upright washing position.

8. The combination recited in claim 6 wherein said torque force providing means comprises a biased hinge connected between said washer and said base.

9. In combination:

a clothes washer having a housing comprising a cabinet front, cabinet sides, a cabinet top having an opening for loading and unloading clothes, and a bottom platform;

said housing having a bottom front truncation;

a stable base pivotally supporting said washer about a horizontal lateral rotational axis wherein said washer is tiltable between an upright position used for washing and a predetermined forward tilt-out position used for loading and unloading clothes through said opening;

means for limiting forward tilting at said predetermined forward tilt-out position;

said bottom platform having at least one rear foot for supporting the rear of said washer and horizontally securing it to said base in said upright washing position; and a biased hinge connected between said housing and said base to provide torsion for urging rotation of said washer towards said upright washing position for engaging said foot against said base.

10. The combination recited in claim 9 wherein said foot has a hollow and said base has a pedestal congruent therewith, said foot being aligned for said hollow seating on top of said pedestal in said upright washing position.

11. In combination:

a clothes washer having a cabinet comprising a front, sides, and a top with an opening for loading and unloading clothes, said cabinet having a bottom front truncation;

a stationary partition mounted above said washer thereby preventing access to said opening when said washer is in an upright washing position underneath said partition;

a stable base pivotally supporting said washer about a horizontal rotational axis laterally disposed forward of the center of gravity of said washer and rearward of said truncation;

a hook connected to said base for limiting forward rotation of said washer about said rotational axis at a tilt-out position providing access to said opening from under said partition for loading and unloading clothes;

said washer comprising rear feet for supporting the rear of said washer on said base in said upright washing position, said feet comprising means for horizontally securing said rear of said washer to said stable base in said upright washing position; and a biased hinge connected from said washer to said base for providing torsion for urging said washer to rotate about said axis toward said upright washing position so that said feet seat firmly on said base.

12. A top loading clothes washer adapted for installation under a stationary clothes dryer limiting access to the top of said washer, comprising:

a washer housing comprising a cabinet front, cabinet sides, a cabinet top having an opening for loading and unloading clothes, and a bottom platform, said housing having a bottom front truncation;

means for tilting said washer forward from an upright washing position to a tilt-out position wherein at least a portion of said opening is out from under said clothes dryer thereby providing access to said opening for loading and unloading clothes, said tilting means comprising a stable base pivotally supporting said housing about a rotational axis in front of the center of gravity of said washer and in back of said truncation;

means connected to said base for preventing forward tilting of said washer past said tilt-out position;

said housing comprising means for resting the rear of said washer on said base in said upright washing position of said washer;

said resting means comprising means for horizontally securing said rear of said washer to said base in said upright washing position; and means for providing an upward force on the front of said washer to urge backward rotation of said washer about said rotational axis towards said upright washing position thereby engaging said horizontally securing means.

13. The washer recited in claim 12 wherein said resting means comprises a pair of feet each having a bottom hollow aligned for seating over pedestals connected to said base.

14. A top loading clothes washer adapted for being positioned under a stationary structure and tilting forward to provide access to its top for loading and unloading clothes, comprising:

a washer housing encased by a bottom platform, a cabinet front, cabinet sides, and a cabinet top having an opening for loading and unloading clothes, said housing having a bottom front truncation;

a rectangular stable frame base having a back, front, and sides, said base comprising means for pivotally supporting said housing about a horizontal rotation axis lateral to said washer and disposed in front of the center of gravity of said washer and behind said truncation wherein said washer is tiltable between an upright position used for washing and a forward tilt-out position used for loading and unloading clothes;

a hook connected to said back of said frame base for engaging said housing at said tilt-out position thereby preventing further forward tilting;

a pair of truncated conical pedestals connected to said back of said frame base;

a pair of feet with hollows connected to the rear of said bottom platform of said housing and aligned for receiving said pedestals in said hollows when said washer is tilted back to said upright washing position, the mating of said pedestals in said hollow providing support and horizontally securing said washer to said base in said upright washing position; and a torsion hinge connected from the front of said housing to said front of said base, said torsion hinge urging rotation of said washer in a backward direction thereby engaging said pedestals in said hollows in said upright washing position.

* * * * *